United States Patent [19]

Ravesloot

[11] 3,969,180

[45] July 13, 1976

[54] APPARATUS FOR LAYING DOWN A TAPE STRIP

[76] Inventor: Donald Ravesloot, 15646 S. Emerald Ave., Harvey, Ill. 60426

[22] Filed: May 17, 1974

[21] Appl. No.: 470,989

Related U.S. Application Data

[63] Continuation-in-part of Ser. No. 259,746, June 5, 1972, abandoned.

[52] U.S. Cl. ..... 156/523; 156/577; 156/579; 225/47; 225/87; 225/89; 225/96

[51] Int. Cl.[2] ..... B32B 31/18; B65H 35/10

[58] Field of Search ..... 156/523, 527, 577, 579, 156/574, 576, 584; 225/46, 51, 66, 52–59, 47, 84, 87, 89, 96

[56] References Cited

UNITED STATES PATENTS

| | | | |
|---|---|---|---|
| 1,332,194 | 3/1920 | Arcus | 225/86 |
| 2,324,204 | 7/1943 | Fisher | 156/527 |
| 2,684,716 | 7/1954 | Mills et al. | 225/51 |
| 3,051,223 | 8/1962 | Waltz | 156/527 |
| 3,098,782 | 7/1963 | Powers | 156/527 |
| 3,146,149 | 8/1964 | Silverstein | 156/577 |
| 3,404,058 | 10/1968 | Fink, Jr. | 156/527 |
| 3,410,465 | 11/1968 | Costello | 225/82 |
| 3,567,557 | 3/1971 | Kingery et al. | 156/523 |
| 3,586,587 | 6/1971 | Boyce | 156/527 |
| 3,725,182 | 4/1973 | Regan | 156/522 |
| 3,785,901 | 1/1974 | Fritzinger | 156/577 |
| 3,798,106 | 3/1974 | Jenkins et al. | 156/577 |

*Primary Examiner*—Douglas J. Drummond
*Assistant Examiner*—M. G. Wityshyn
*Attorney, Agent, or Firm*—Wegner, Stellman, McCord, Wiles & Wood

[57] ABSTRACT

An apparatus for laying down a strip of flexible tape from a roll supply including an elongated dispensing portion adapted to dispense the tape from a distal end thereof so as to lay down the tape on a subjacent surface by a rearward movement of the apparatus with the dispensed portion of the tape being held to the surface.

20 Claims, 15 Drawing Figures

111
140
5
126
138
117
158
112
113
158
111
110
162
159
126
137
136
124
139
133
135
116
119
122
111
117
132
134
123
14.
14.
138
142
140
144
143
120
113
119
117
141
115
111
118
114
125
158
162
159
126
132
142
140
144
116
114
163
160
162
161
158
15.
15.
163
160
162
141
142
143
120
119
125
124
123
111
126
122
127
126
125
123
119
117
129
131
130
116
111
128
113
124
153
155
145
147
149
156
148
142
157
146
144
152
120
141
150
151
154
116
111
121
122

APPARATUS FOR LAYING DOWN A TAPE STRIP

CROSS-REFERENCE TO RELATED APPLICATIONS

This application comprises a continuation-in-part of my copending application Ser. No. 259,746, filed June 5, 1972, for an Apparatus for Laying Down a Tape Strip, now abandoned.

BACKGROUND OF THE INVENTION

1. Field of the Invention

This invention relates to apparatus for laying down tape from a roll supply.

2. Description of the Prior Art

In the conventional devices for dispensing tape such as masking tape, adhesive tape, adhesive backed plastic tape, etc., a supply roll of the tape is rotatably carried by one portion of the dispenser with a distal end of the tape being extended from the roll supply to a cutting or tearing element, permitting the end of the tape to be separated from the supply roll and applied as desired with the user's hands. At times, such dispensers are utilized by manipulation thereof so as to cause the distal end of the tape to be attached to a surface and the entire dispenser moved rearwardly therefrom so as to withdraw a further portion of the tape from the roll supply and permit it to be then pressed against other portions of the surface. At best, such manipulation of the conventional dispensers is difficult and awkward and does not permit facilitated laying down of the tape along preselected lines.

Any substantial number of different tape-applying devices have been developed over the years as illustrated in the following U.S. Pat. Nos.:

| | |
|---|---|
| 677,128 | Glenzinger |
| 2,324,204 | Fischer |
| 2,334,458 | Van Tuyl |
| 2,932,421 | Schiefer |
| 3,098,782 | Powers |
| 3,051,223 | Waltz |
| 3,156,603 | Robinson |
| 3,404,058 | Fink, Jr. |
| 3,567,557 | Kingery, et al |
| 3,709,760 | Knoner |

Thus, in U.S. Pat. No. 677,128 of William Glenzinger, a striping and ornamenting device is illustrated having a handle attached at one end to a body and a plurality of rollers at the opposite end with tape strip roll being received rotatably within the body. In Howard L. Fischer, U.S. Pat. No. 2,324,204, a tape dispenser is shown wherein the body defines a casing further providing the handle means of the dispenser. The pressing roller is made of rubber or other soft material and may be molded with the axle shaft formed integrally, in which case, it is made of plastic material.

In U.S Pat. No. 2,334,458 of Sidney E. Van Tuyl, a label handling apparatus is shown defining an elongated dispensing channel for feeding gummed tags or labels in strip form and securing them successively to a receiving surface. In Ernest H. Schiefer, U.S. Pat. No. 2,932,421, a flat tape applicator is shown for applying adhesive tape along the edge of a sheet of material.

Edward Waltz, U.S. Pat. No. 3,051,223 shows a device for dispensing adhesive tape from a roll having an elongated hollow handle with means at the rear end for rotatably supporting the tape roll and a roller at the front end for applying the tape to a receiving surface.

The applicator roller includes an axle having integral pins journalled in the hollow handle and includes a rubber outer sleeve. A lever is provided for retarding the rotational movement of the tape roll and is normally biased thereagainst by a suitable spring. The distal end of the tape is separated from the strip by rocking or pivoting the dispenser so as to draw the tape across the cutting edge of a cutting blade at the front end of a handle.

The Howard A. Powers, U.S. Pat. 3,098,782 shows a tape dispenser adapted to lay the tape in curving patterns without necessitating a change in the grip by the user on the dispenser handle. The handle is mounted for free rotatable movement relative to the pressing means with the lowest extremities of the pressing means being offset from the axis of rotation of the handle. The pressing means comprises a generally barrel-shaped, or crowned roller and the tape-severing means comprises a spring loaded cutter.

Clifford C. Robinson shows, in U.S. Pat. No. 3,156,603, a tape dispenser wherein an annular handle is provided with a projecting dispensing portion and which includes a rest for the user's index finger for controlling the laying down of the tape. The housing is provided with thin side walls which are reinforced and includes a window for determining the need for additional supply of tape.

In John F. Fink, Jr. U.S. Pat. No. 3,404,058, a tape applicator is shown for dispensing double-faced pressure tape. A plurality of pressure rollers are located near the front and rear of the body, each defining grooved sealers with the roller near the forward end of the body defining a pressure applicator roller. A palm-conforming holding plate is provided on the housing for manually guiding the dispenser.

In U.S. Pat. No. 3,567,557 of John D. Kingery, et al., a masking tape and masking paper applicator is disclosed including a handle frame and holder frame having common spring connecting means. The applicator roller has an enlarged bore permitting the roller to move relative to the axle for deflecting the roller tape and roller frame resiliently.

In U.S. Pat. No. 3,709,760 of Joachim H. Knoner, a manual adhesive tape applicator is shown having a rear handle and central means for journalling a roll of adhesive tape. A supporting roller is provided at the front end of the frame in addition to the tape pressure applicator device.

SUMMARY OF THE INVENTION

The present invention comprehends an improved apparatus for laying down a strip of flexible tape from a roll supply. The apparatus includes means for guiding the tape as it is dispensed along a desired tape-lay line for facilitated laying-down of the tape as desired. The apparatus may, if desired, by utilized in the manner of a conventional dispenser to merely dispense a preselected length of tape from the roll supply with the preselected length being separated from the supply by suitable separating means associated with the apparatus.

The apparatus includes a carrier portion defining a hand gripping means spaced rearwardly of a forward end thereof, permitting the tape to be dispensed from the distal end of the carrier onto a desired surface and is adapted for laying the tape down onto such a surface in constricted spaces. Thus, the apparatus may be used to initiate the laying-down of a strip of tape accurately in a corner where difficulty is had in effecting such laying down with conventional tape dispensers.

The apparatus includes roller means for guiding the tape from the roll supply and for improved urging of the tape onto the surface to which it is to be applied. In the present embodiment, the guiding roller provided at the front end of the handle portion includes a resilient core and a substantially rigid outer sheath. The core resiliently permits the roller to deflect angularly relative to the axis of rotation of the roller on a shaft extending transversely across the tape passage of the handle so as to provide improved laying down of the tape as along irregular lines. The resilient core may be provided with an internal tubular support providing low friction rotation of the roller on the shaft while yet permitting the desirable deflection thereof afforded by the resilient core. The roller may project forwardly from the front end of the handle so as to comprise the forwardmost portion of the device.

For improved accuracy in the laying down of the tape, the tape is guided through a delivery passage by apposed side walls of the handle, the spacing between which may be manually adjusted to conform accurately to the width of the tape being dispensed. In the illustrated embodiment, the spacing adjusting means comprises threaded means extending between the handle side walls for adjustably constricting the handle thereat. The adjusting means is preferably disposed adjacent the tape applying roller for improved accurate dispensing of the tape.

The tape roll may be journalled on a pair of large diameter trunions carried on resilient rearward extensions of the handle. The trunions are biased by the handle extensions into the hollow center of the tape roll so as to maintain the tape roll normally rotatably supported for dispensing of tape therefrom. The handle extensions may be resiliently spread apart to provide facilitated installation of a new tape roll or removal of a spent tape roll as desired.

The present invention further comprehends an improved means for cutting the tape at the front end of the handle defined by a movably mounted cutter which may be selectively retracted from the cutting position when desired. In the illustrated embodiment, the tape cutter is pivotally mounted to the handle to be swung between the forwardly extending cutting position and rearwardly extending retracting position. Spring means may be provided for yieldingly retaining the cutter in either of these positions.

The invention further comprehends the provision of means for holding the tape within the dispensing passage so as to permit a rearward movement of the handle to fully separate previously applied tape partially severed by the cutting means. In the illustrated embodiment, the holding means comprises a pressure pad which is manually urged against the tape to hold the tape against a portion of the handle wall defining the delivery passage. The pressure pad may be biased to a retracted position permitting normal free movement of the tape therepast, and in the illustrated embodiment, the spring means provided for selectively retaining the swingable cutter further defines the means for resiliently biasing the pressure pad. A plunger may be provided to permit manual operation of the pressure applying means and in the illustrated embodiment, the plunger further defines the means for pivotally mounting the cutter to the handle.

The handle defines an elongated tubular element permitting selective disposition of the user's hand at a wide range of distances from the distal end for use in applying tape under different conditions. In the illustrated embodiment, the handle has a length of approximately twice the width of a user's hand to provide substantial variability in the positioning of grasping of the handle in use.

The apparatus is extremely simple and economical of construction while yet providing the highly desirable features discussed above. The apparatus may be made relatively small in size and light in weight for facilitated manipulation. The apparatus is adapted for facilitated replacement of the tape roll supplies and may be used with any conventional flexible tape such as masking tape, adhesive backed plastic tape, including double coated tape, etc.

BRIEF DESCRIPTION OF THE DRAWING

Other features and advantages of the invention will be apparent from the following description taken in connection with the accompanying drawing wherein.

DESCRIPTION OF THE PREFERRED EMBODIMENTS

Figures 1, 2, 3, 4, 5, 6, 7, 8:
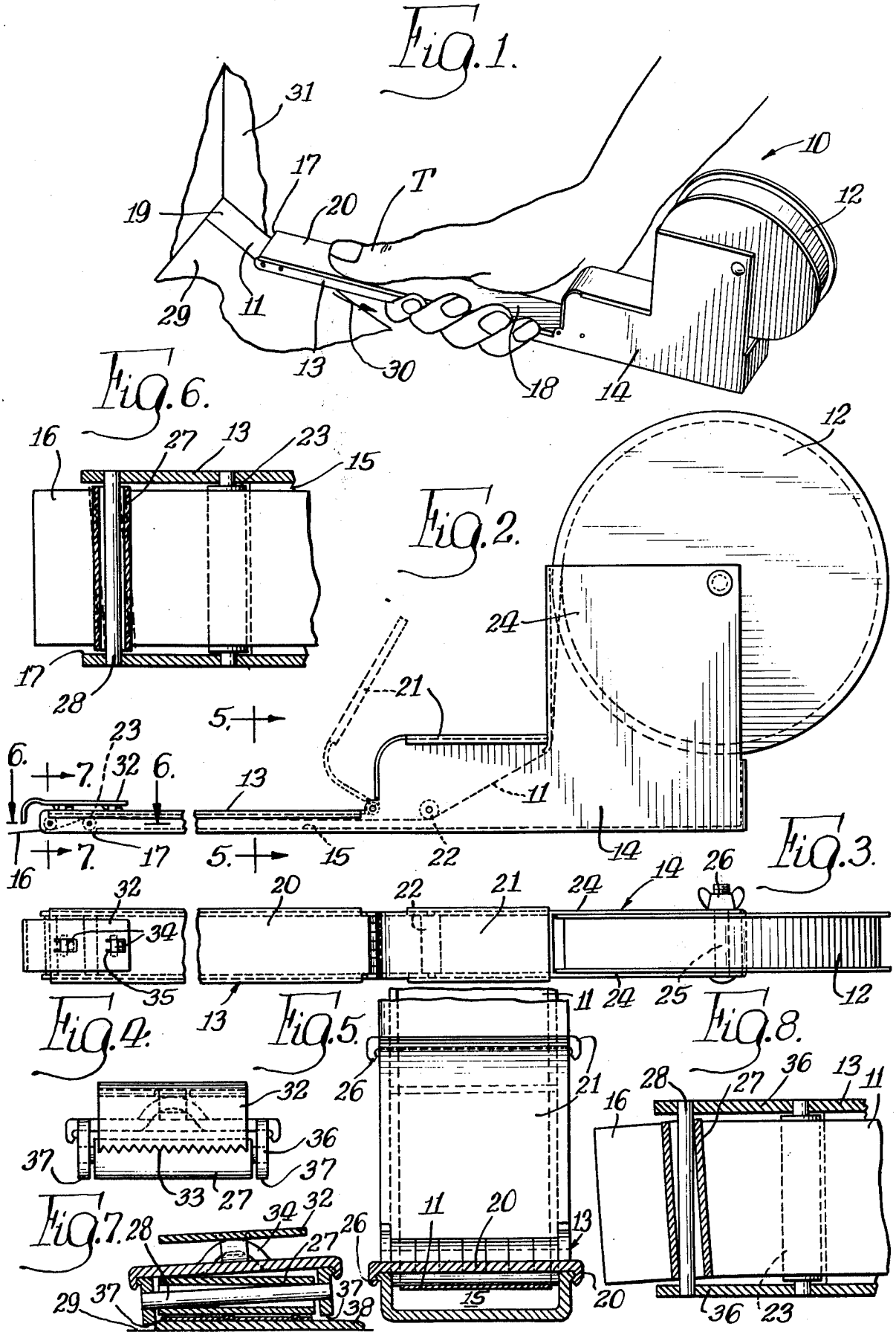
FIG. 1 is a perspective view of an apparatus for laying down a tape strip embodying the invention, illustrated as being used in laying a tape strip from a corner structure.
FIG. 2 is a broken side elevation of the apparatus.
FIG. 3 is a broken top plan view thereof.
FIG. 4 is an enlarged front end elevation thereof.
FIG. 5 is an enlarged vertical section taken substantially along the line 5—5 of FIG. 2.
FIG. 6 is a fragmentary enlarged horizontal section taken substantially along the line 6—6 of FIG. 2.
FIG. 7 is a transverse section taken substantially along the line 7—7 of FIG. 2.
FIG. 8 is a horizontal section similar to that of FIG. 6 but illustrating a turning arrangement of the floating roller.

In the exemplary embodiment of the invention as disclosed in FIGS. 1–8 of the drawing, an apparatus generally designated 10 for laying down a strip 11 of flexible tape from a roll supply 12 is shown to comprise an elongated carrier 13 provided at its rearward end with a support 14 for rotatably carrying the roll supply 12. The tape strip 11 is withdrawn from the roll supply 12 to extend through a passage 15 in the carrier 13 so as to expose the distal end 16 of the tape strip at a forward open end 17 of the carrier and thereby effect the desired laying down of the tape strip as illustrated in FIG. 1.

Apparatus 10 may be formed of any suitable material such as sheet metal, molded plastic, etc. The carrier 13 includes a removable cover 20. A hinged cover portion 21 is mounted to the carrier at the front end of support 14 as illustrated in FIG. 2, so as to cooperate with the removable cover 20 in exposing the passage 15 through which the tape 11 is extended from the roll supply 12 to the open end 17 of the carrier. A plurality of guide rollers such as rollers 22 and 23 may be provided in passage 15 for guiding the tape smoothly from the roll supply 12 to the dispensing position at open end 17.

The support 14, as best seen in FIG. 4, includes a pair of spaced walls 24 for rotatably receiving the roll supply 12 therebetween on an axle bolt 25 which may be removably secured to extend between walls 24 by suitable wing bolt 26. Thus, the apparatus 10 comprehends the use of suitable means for facilitated replacement of a spent roll supply with a fresh roll supply when desired. As shown in FIG. 5, the covers 20 and 21 may be provided with inturned side flanges 26 for releasably locking the covers in place in the closed position while permitting facilitated opening of the passage 15 when desired.

As shown in FIG. 6, the distal end 16 of the tape is drawn over the roller 23 in the carrier passage 15 and then under a front pressure roller 27 loosely carried on a pin 28 so as to float at the front opening 17 on the pin 28 and thereby facilitate urging of the tape strip distal portion 16 onto the subjacent surface 29 along a desired line. As shown in FIG. 7, when it is desired to turn the strip portion 16 to follow a nonrectilinear line, the roller 27 cocks suitably on the pin 28 to guide the tape strip portion 16 therealong. As shown in FIG. 1, the user may apply pressure downwardly through the roller 27 by pressing downwardly with his thumb T on the cover 20 of the carrier 13 rearwardly adjacent the front end 17 thereby firmly urging the tape strip end portion 16 onto the surface 29. As the dispensed end portion 19 effectively holds the tape against rearward displacement, the dispensing operation is readily effected by simply withdrawing the apparatus 10 rearwardly from the held end 19 in the direction of the arrow 30, as shown in FIG. 1, while urging the subsequently dispensed distal portion 16 of the tape along the desired line on the surface 29. Thus, as shown, the tape end 19 may be quickly and easily accurately laid down in a corner space 31 as well as along freely accessible surface portions. Apparatus 10 further includes, adjacent the forward end 17, means for separating the distal end 16 from the strip 11 when desired. Illustratively, the separating means may comprise a spring steel cutter 32 having a serrated downturned front end 33 overhanding the front end 17 of the carrier. The cutter may include suitable tangs 34 received in slots 35 in cover 20 for removably securing the severing means to the apparatus permitting the removal thereof such as when it is desired to lay the tape into a corner space 31. To sever the dispensed distal portion 16 from the remainder of the strip, the user merely presses down on the front end of the cutter 32 to urge the serrated edge 33 against the distal tape end 16 permitting it to be torn off in the conventional manner As the tape is drawn through the carrier against the rollers and applied by the pressure of the guide roller 27, a preselected drag on the tape is provided for facilitating the application of the tape to surface 29. To further facilitate the tracking of the tape along the desired line of application, the carrier 13 defines forward side walls 36 carrying the pin 28 and defining leading tracking edges 37 spaced apart at opposite sides of the tape and adapted to engage the surface 29. The tracking edges 37 tend to cause the carrier to track in a straight line for facilitated laying down of the tape. However, when it is desired to follow a nonrectilinear line, the roller 27 may extend to below the edge 37, as shown in FIG. 7, thereby permitting the roller to facilitate guiding of the laying down action along the nonrectilinear line. Further, as illustrated in FIG. 7, the edges 37 may be utilized to bear against raised elements on surface 29, such as a chrome strip 38 for guiding the forward end of the apparatus along the strip 38 and thereby applying the masking tape accurately onto the strip such as for use in painting an automobile or the like. The edges 37 may be rounded for facilitated guiding action.

The carrier passage is preferably slightly wider than the width of the tape to be laid down. Illustratively, the guide rollers may have a ¼ inch outer diameter with the roller 27 having an inner diameter of approximately 3/16 inch where the pin 28 has an outer diameter of 3/64 inch. As shown, the apparatus is relatively small in size while yet providing the desirable facilitated laying down of the tape.

Figures 9, 10, 11, 12, 13, 14, 15:
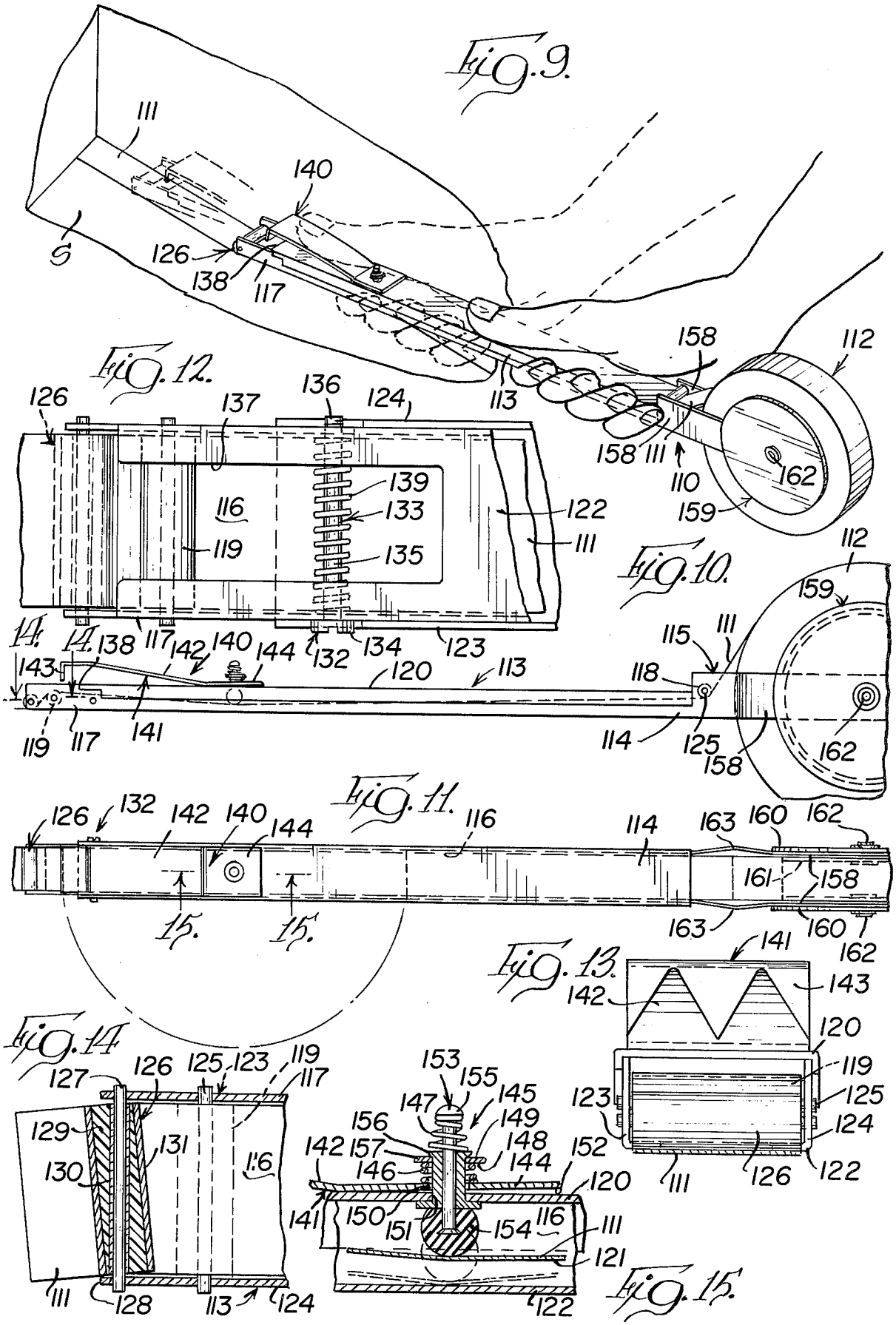
FIG. 9 is a perspective view of a modified form of apparatus for laying down a tape strip embodying the invention, illustrated as being used in laying a tape strip from a corner structure.
FIG. 10 is a fragmentary side elevation of the apparatus.
FIG. 11 is a fragmentary top plan view thereof.
FIG. 12 is a fragmentary bottom plan view of the forward end of the apparatus.
FIG. 13 is a front elevation of the front end of the apparatus.
FIG. 14 is a fragmentary enlarged transverse section taken substantially along the line 14—14 of FIG. 10.
FIG. 15 is a fragmentary enlarged vertical section taken substantially along the line 15—15 of FIG. 11.

Referring now to FIGS. 9–15 of the drawing, a modified form of apparatus generally designated 110 for laying down a strip 111 of flexible tape from a roll supply 112 includes an elongated handle 113 provided at its rearward end 114 with means generally designated 115 for removably rotatably carrying the roll supply 112. The tape strip 111 is passed from roll 112 through a longitudinal passage 116 defined by the holder handle 113 to be dispensed at the front end 117 of the handle by a suitable rearward movement of the apparatus, as illustrated in FIG. 9. The apparatus defines an improved construction facilitating such laying down of the tape in corners and accurately along edges of the receiving surface for improved facilitated tape dispensing.

As best seen in FIGS. 10 and 11, handle portion 113 comprises an elongated thin tubular structure providing facilitated gripping in different positions for use in different tape laying applications. Thus, as shown in FIG. 9, where a short piece of tape is to be applied, such as for masking a small extent of the receiving surface, the user may grip the forward end of the handle portion. Where the apparatus is to be used for masking a long extent of receiving surface, the user may grasp the rearward portion of the handle, as shown in full lines in FIG. 9, so as to provide maximum clearance at the forward end of the apparatus for facilitated tape application. In the illustrated embodiment, the handle portion 113 has a length of at least approximately twice the normal user's hand width, i.e., approximately 12 inches.

The tape strip may be guided from roll 112 through the passage 116 of handle 113 by suitable rollers, such as rear roller 118 at rear end 114 of the handle and front roller 119 at front end 117 of the roller. As shown in FIG. 10, the rollers guide the tape closely subjacent the upper wall 120 of the handle so as to space the adhering surface 121 of the tape above the bottom wall 122 of the handle as the tape is drawn through passage 116. The guide rollers may be journalled in the side walls 123 and 124 of the handle portion on suitable pins 125.

As shown in FIGS. 9 and 14, the tape strip is applied to the receiving surfaces S by a deflectible roller generally designated 126 rotatably carried on a shaft 127 at the distal end of front portion 117 of handle 113. Shaft 127 extends transversely across passage 116 and is carried by the side walls 123 and 124 to dispose the roller substantially flush with the bottom wall 122 of handle portion 113. Shaft 127 mounts the roller to project slightly forwardly from the distal end 128 of handle front portion 117, as shown in FIG. 14.

As further illustrated in FIG. 14, roller 126 includes a resilient tubular core 129 carried on an inner tubular support 130 coaxially rotatably mounted on shaft 127. An outer sheath 131 coaxially surrounds resilient core 129 and is preferably formed of a relatively hard or rigid material for pressing the tape strip 111 against the receiving surface S. In the illustrated embodiment, sheath 131 is formed of a relatively rigid synthetic resin and the core 129 is formed of a relatively soft resilient synthetic resin. Illustratively, the core may be formed of foamed polyurethane. Tubular support 130 preferably may be formed of a relatively hard synthetic resin providing good wear characteristics for improved mounting of the roller on the shaft 127.

As shown in FIG. 14, the resilient core 129 permits the roller to deflect angularly relative to the axis of shaft 127 in the laying down of the tape 111 so as to accurately follow a desired irregular line on receiving surface S. Thus apparatus 110 may be utilized for accurately masking curved edges of the receiving surfaces with the resiliently biased roller providing improved tracking thereof.

For further improved accuracy in the laying down of tape strip 111, the handle 113 is selectively constricted so as to space the side walls 123 and 124 accurately the width of the tape strip. It has been found that conventional tape strips vary substantially in the width dimension. To accommodate such variations in tape strip widths, a constricting device generally designated 132 is provided. As best seen in FIG. 12, the constricting device comprises a threaded member 133 having a head 134 abutting one side wall such as side wall 123 of handle 113, a shank 135 extending transversely across passage 116, and a threaded distal end 136 threaded to the opposite side wall of the handle such as side wall 124. Bottom wall 122 is provided with a central recess 137 extending rearwardly from front end 117 of the handle and the upper wall 120 terminates at a front end 138 substantially rearwardly of front end 117 so as to provide resilient constrictibility of handle portion 113 between side walls 123 and 124. Thus, as illustrated in FIG. 12, threaded adjustment of element 133 adjustably spaces the walls 123 and 124 adjacent front end 117 so that the spacing therebetween may be accurately equal to the width of the tape strip 111 (or only slightly greater than the width thereof) for accurate facilitated guiding of the tape strip to the application roller 126. As shown in FIG. 12, a biasing spring 139 may be coaxially mounted about member 133 to bias the side walls 123 and 124 apart and lock the adjusting element 133 in the adjusted position.

As further discussed above, the present invention comprehends an improved tape severing means, herein generally designated 140, including a cutter 141 having a spring portion 142 defined at its forward end by a downturned serrated cutting blade 143 which is disposed slightly forwardly of top wall leading edge 138 for engaging the tape strip rearwardly of the forward roller 119 to effect a partial separation of the distal applied end from the strip portion in passage 116.

Spring portion 142 is provided at its rear end with a mounting portion 144. As best seen in FIG. 15, portion 144 is biased against upper wall 120 by spring means generally designated 145 including a first coil spring 146 and a second coil spring 147. First spring 146 is received within an annular channel 148 of a spool 149 extending through an opening 150 in spring mounting portion 144 and an opening 151 in upper wall 120. The rearward distal end of the mounting portion defines a downturned flange 152 which is thusly biased against the top wall 120 by the captured spring 146. While permitting the pivotal swinging of the cutter 141 about the axis of the spool from a forward cutting position shown in full lines in FIGS. 10 and 11, and a retracted position shown in dotted lines in FIG. 10. The spring 146 provides a yieldable retention of the cutter 141 in the selected positions.

As further illustrated in FIG. 15, a plunger 153 extends coaxially through spool 149 and is provided at its lower end with a pressure pad 154 disposed in passage 116 above tape strip 111. Pad 154 is normally biased upwardly against spool 149 within passage 116 by coil spring 147 extending between the spool and an enlarged manipulating head 155 of the plunger. When it is desired to hold the tape 111 against withdrawal from the forward end of the passage 116, such as in separating a previously partially separated applied portion of the tape from the strip in passage 116, the user merely depresses plunger 153 to urge pad 154 against the tape and press the tape against the bottom wall 122 of the handle as shown in dotted lines in FIG. 15. Rearward movement of the handle with the tape so held against bottom wall 122 efficiently effects a complete operation of the previously partially torn distal strip portion whereupon release of the plunger 153 permits further dispensing of tape through passage 116 as a new, separately applied portion.

Spool 149 may be provided with a relatively small upper flange 156 and an enlarged washer 157 for facilitated installation of the spool through the openings 150 and 151.

Thus, the cutter 141 is effectively mounted for swinging movement about the axis of plunger 153 with the plunger head 155 being disposed for facilitated manipulation by the user's thumb, as best may be seen by reference to FIG. 9 of the drawing. As further shown therein, the cutting blade 143 may be engaged with the tape strip while the plunger 153 is concurrently depressed by the pressing of the user's thumb against both the cutter portion 142 and the plunger head 155 if so desired.

The invention further comprehends an improved mounting of the tape roll 112 for facilitated delivery of the tape therefrom through passage 116. Thus, as shown in FIGS. 9–11, the rear portion 114 of handle 113 defines a pair of rearwardly extending extensions 158. Each extension is provided with a trunions generally designated 159 including an outer circular plate 160 and an inner circular plate 161 secured to the extension 158 by suitable axial securing means such as rivets 162. The diameter of inner plate 161 is preferably closely similar to the inner diameter of the core of the conventional tape roll and the diameter of the outer plate 160 is slightly larger so as to effectively define spaced apposed trunions rotatably mounting the tape roll on opposite axial sides thereof. The handle extensions 158 preferably comprise resilient extensions permitting selective spacing of the trunions when desired for facilitated installation of a new roll or removal of a spent roll core from the apparatus. The axial thickness of plates 161 may be suitably selected to provide positive journalling of the tape roll core while yet permitting the installation and removal with a suitable small spacing of the handle extensions 158. In the illustrated embodiment, the handle extensions 158 are formed integral with the handle side walls 123 and 124. As shown in FIG. 11, the extensions may include an angled connecting portion 163 adjacent rear portions 114 of the handle to provide improved control of the resilient mounting of the tape roll on the trunions.

In the illustrated embodiment, upper wall 120 of handle 113 defines a downwardly opening channel overlying the side walls 123 and 124, as best seen in FIG. 13. As will be obvious to those skilled in the art, other suitble handle constructions may be utilized within the scope of the invention.

In utlizing the tape applying apparatus of the present invention, the user firstly threads the tape from the roll carried on the trunions 159 through passage 116 to extend to subjacent pressure applying roller 126 at the forward end of the handle 113. The tape is then applied to the receiving surface by drawing the handle rearwardly while concurrently pressing the forward end downwardly to urge the tape strip against the receiving surface and withdraw the strip from the roll 112 through passage 116. The improved resiliently mounted pressure applying roller permits the user to accurately follow curved lines in applying the tape as well as to provide accurate conformity with straight edges. The substantial elongated extent of the handle permits the user to select the most advantageous position for controlling the application of the tape. By permitting the retraction of the cutter from adjacent the front distal end of the holder, further improved facility in applying tape in close quarters is provided.

The applied tape is separated from the roll in an improved facilitated manner by the use of the pressure pad for holding the tape portion in passage 116 while the user moves the forward end of the handle away from the previously applied and partially severed tape strip with the user's hand being applied to the handle automatically for facilitated depression of the pressure applying plunger and concurrent manipulation of the handle to effect the desired separation. Installation and removal of the tape from the apparatus is made extremely simple by means of the improved split trunion mounting means.

The upper wall may be readily removed from the handle when desired for facilitated threading of a new tape strip through passage 116. The cutting means and pressure applying means are mounted to the top wall and, thus, are automatically removed and reinstalled concurrently with the upper wall of the handle.

The improved means for adjusting the spacing of the side walls of the handle adjacent the pressure applying roller providing an improved accuracy in the tape laying operation notwithstanding a variation in the tape width such as found in the tapes of different manufacturers of nominal similar size.

The foregoind disclosure of specific embodiments is illustrative of the broad inventive concepts comprehended by the invention.

I claim:

1. Apparatus for applying to a surface a strip of flexible tape from a roll supply, comprising: an elongated handle defining opposite first and second ends and a through passage between said ends for conducting tape from said supply for application of the tape to a surface at said first end; means disposed at a position within said handle passage for partially separating thereat a distal portion of the tape applied to the surface from the tape strip within said handle passage; means on said handle first end for holding the partially separated distal portion against a surface to which it is to be applied; and manually operable means for selectively holding the supply portion of the partially severed tape strip in said handle passage against withdrawal movement to effect full separation of said distal portion therefrom as an incident of a concurrent holding of the tape strip by said holding means and movement of said handle first end away from the applied distal portion.

2. The tape strip applying apparatus of claim 1 wherein said second end of the handle is provided with a pair of spaced apposed trunions for journalling the tape roll supply for withdrawal of the tape therefrom through said handle passage.

3. The tape strip applying apparatus of claim 1 wherein said handle end defines opposite sides, said apparatus further including means for selectively urging said opposite sides of the handle end transversely toward each other to provide accurate side guiding of the tape strip as it is applied from said first end.

4. The tape strip applying apparatus of claim 1 including means for pivotally mounting the separating means to said handle.

5. The tape strip applying means of claim 1 wherein said second end is provided with a pair of spaced apposed trunnions for rotatably journalling the tape roll supply to extend substantially equally above and below the longitudinal extent of the elongated handle for withdrawal of the tape therefrom through said handle through passage.

6. The tape strip applying apparatus of claim 5 wherein said mounting portions resiliently bias the trunions to the roll journalling disposition while permitting ready manual separation to permit selective installation of a new roll therebetween and removal of a spent roll therefrom.

7. The tape strip applying apparatus of claim 5 wherein each said trunion defines an inner cylindrical roll support, and an outer annular flange for preventing outer axial movement of the tape roll journalled thereon.

8. The tape strip applying apparatus of claim 5 wherein said trunions are arranged to cause the axis of the tape roll to intersect a longitudinal axis of said handle passage.

9. Apparatus for applying to a surface a strip of flexible tape from a roll supply, comprising: an elongated handle defining opposite first and second ends and a through passage between said ends for conducting tape from said supply for application of the tape to a surface at said first end; means for partially separating a distal portion of the tape applied to the surface from the tape strip within said handle passage; and manually operable means for selectively holding the tape strip in said handle passage against withdrawal movement to effect full separation of said distal portion therefrom as an incident of concurrent holding of the tape strip and movement of said handle first end away from the applied distal portion, said means for partially separating the tape strip being movably mounted to said handle for selective positioning in a tape separating position at said first end of the handle, and in a retracted position spaced substantially from said first end of the handle, said holding means including a manually operable plunger, and said means for partially separating the tape strip being swingably mounted to said plunger.

10. The tape strip applying apparatus of claim 9 wherein means are provided for biasing said holding means to a released position permitting unimpeded movement of the tape strip in said passage therepast.

11. Apparatus for applying to a surface a strip of flexible tape from a roll supply, comprising: an elongated handle defining opposite first and second ends and a through passage between said ends for conducting tape from said supply for application of the tape to a surface at said first end; means for partially separating a distal portion of the tape applied to the surface from the tape strip within said handle passage; and manually operable means for selectively holding the tape strip in said handle passage against withdrawal movement to effect full separation of said distal portion therefrom as an incident of concurrent holding of the tape strip and movement of said handle first end away from the applied distal portion, said first end of the handle being provided with a yieldable roller for applying pressure to the tape being applied to the surface, said roller including a resilient core biasing the roller to a transverse normal position perpendicular to the longitudinal extent of the tape strip.

12. Apparatus for applying to a surface a strip of flexible tape from a roll supply, comprising: an elongated handle having a pair of spaced side walls defining an end of the handle and a through passage through said end for conducting tape from said supply for application of the tape to a surface at said handle end; means for separating a distal portion of the tape applied to the surface from the tape strip within said handle passage; and means for transversely adjusting the spacing of said side walls from a centerline of the handle end to provide accurate centered guiding of the tape strip as it is applied from said first end.

13. The tape strip applying apparatus of claim 12 wherein said side wall adjusting means comprises threaded means.

14. The tape strip applying apparatus of claim 12 wherein said side wall adjusting means comprises threaded means and spring means biasing the side walls adjacent the threaded means toward a maximum width passage configuration.

15. The tape strip applying apparatus of claim 12 wherein said handle end is bifurcated and said side wall adjusting means comprises threaded means extending transversely across said passage.

16. Apparatus for applying to surface a strip of flexible tape from a roll supply, comprising:

an elongated handle defining opposite first and second ends and a through passage between said ends for conducting tape from said supply for application of the tape to a surface at said first end;

means for separating a distal portion of the tape applied to the surface from the tape strip within said handle passage; and a yieldable roller for applying pressure to the tape being applied to the receiving surface, said roller including a resilient core rotatably mounted to a shaft supported transversely across said passage at said handle first end, and a substantially rigid tubular outer member coaxially surrounding said core, said core biasing the roller to a transverse position perpendicular to the longitudinal extent of the tape strip.

17. The tape strip applying apparatus of claim 16 wherein said roller includes a rigid support tube coaxially between said resilient core and said shaft for providing a low friction journalling of the roller on the shaft.

18. The tape strip applying apparatus of claim 16 wherein said outer member is formed of a synthetic resin.

19. The tape strip applying apparatus of claim 16 wherein said resilient core is formed of polyurethane.

20. The tape strip applying apparatus of claim 16 wherein said roller extends transversely across said passage at said first end of the handle and projects partially outwardly therefrom.

* * * * *